US009497818B2

(12) United States Patent
Linnartz et al.

(10) Patent No.: US 9,497,818 B2
(45) Date of Patent: Nov. 15, 2016

(54) APPARATUS FOR CONTROLLING LIGHT MODULE

(71) Applicant: KONINKLIJKE PHILIPS N.V., Eindhoven (NL)

(72) Inventors: Johan-Paul Marie Gerard Linnartz, Eindhoven (NL); Anteneh Alemu Abbo, Eindhoven (NL); Yifeng Qiu, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/895,252

(22) PCT Filed: Jun. 5, 2014

(86) PCT No.: PCT/EP2014/061645
§ 371 (c)(1),
(2) Date: Dec. 2, 2015

(87) PCT Pub. No.: WO2014/195385
PCT Pub. Date: Dec. 11, 2014

(65) Prior Publication Data

US 2016/0119998 A1 Apr. 28, 2016

(30) Foreign Application Priority Data

Jun. 5, 2013 (EP) ..... 13170576

(51) Int. Cl.
*H05B 33/08* (2006.01)
*H05B 39/08* (2006.01)

(52) U.S. Cl.
CPC ..... *H05B 33/0851* (2013.01); *H05B 33/0806* (2013.01); *H05B 33/0815* (2013.01); *H05B 39/08* (2013.01)

(58) Field of Classification Search
CPC ..... H05B 33/0815; H05B 33/833; H05B 33/0839; H05B 33/0806; H05B 33/0857; H05B 33/0803; Y02B 20/346
USPC ..... 315/294, 291, 312, 172, 307, 247
See application file for complete search history.

(56) References Cited

U.S. PATENT DOCUMENTS 8,497,637 B2 * 7/2013 Liu ..... H05B 33/0815 315/172
9,066,393 B2 * 6/2015 Recker ..... H05B 33/0815

(Continued)

FOREIGN PATENT DOCUMENTS

WO 2011045372 A1 4/2011

*Primary Examiner* — Haissa Philogene

(57) ABSTRACT

Apparatuses for controlling light modules (5) comprise first circuits (1) for detecting first control information transported via first signals and second circuits (2) for converting first control information into second control information. The second control information is transported via second signals. The first and second control information define light settings of the light modules (5) and have different representations. The first control information may be phase-cut information or first data. The second control information may be a parameter of the second signal or second data. The apparatus may further comprise a third circuit (3) for converting power from the first signals into third signals destined for power inputs (51) of the light modules (5). The second signals may be destined for control inputs (52) of the light modules (5). This way, a control of a light module (5) has been separated from powering the light module (5). Many more control options have become possible.

15 Claims, 4 Drawing Sheets

(56) References Cited

U.S. PATENT DOCUMENTS

| | | | | |
|---|---|---|---|---|
| 9,155,174 | B2 * | 10/2015 | Draper | H05B 41/3924 |
| 2009/0140666 | A1 | 6/2009 | Liao et al. | |
| 2009/0184662 | A1 | 7/2009 | Given et al. | |
| 2010/0301751 | A1 | 12/2010 | Chobot et al. | |
| 2011/0291583 | A1 | 12/2011 | Shen | |
| 2012/0146538 | A1 | 6/2012 | Nerone | |
| 2012/0262084 | A1 | 10/2012 | Liu | |
| 2012/0280638 | A1 | 11/2012 | Pereira et al. | |

* cited by examiner

APPARATUS FOR CONTROLLING LIGHT MODULE

CROSS-REFERENCE TO PRIOR APPLICATIONS

This application is the U.S. National Phase application under 35 U.S.C. §371 of International Application No. PCT/EP2014/061645, filed on Jun. 5, 2014, which claims the benefit of European Patent Application No. 13170576.6, filed on Jun. 5, 2013. These applications are hereby incorporated by reference herein.

FIELD OF THE INVENTION

The invention relates to an apparatus for controlling a light module. The invention further relates to a light module. Examples of such a light module are light modules comprising light emitting diode circuits.

BACKGROUND OF THE INVENTION

U.S. 2012/0262084 A1 discloses a constant voltage dimmable LED driver.

SUMMARY OF THE INVENTION

It is an object of the invention to provide an apparatus for controlling a light module. It is a further object of the invention to provide a light module.

According to a first aspect, an apparatus for controlling a light module is provided, the apparatus comprising

- a first circuit for detecting first control information, the first control information being transported via a first signal, and
- a second circuit for converting the first control information into second control information, the first and second control information defining light settings of the light module, a representation of the second control information being different from a representation of the first control information, and the second control information being transported via a second signal, the first signal being a combination of a power signal and a control signal, and the second signal being a control signal.

The apparatus comprises a first circuit for detecting first control information transported via a first signal. The first signal is a combination of a power signal and a control signal. Such a first signal comprising the first control information for example originates from a classical dimmer. The apparatus further comprises a second circuit for converting the first control information into second control information. The first and second control information define light settings of the light module, such as light parameters, such as intensities and color points etc. The second control information is transported via a second signal. The second signal is a control signal.

Power signals are configured to power loads. Control signals are not configured to power loads. Power signals comprise sufficient amounts of power to power the loads. Control signals do not comprise sufficient amounts of power to power the loads. Control signals are configured to transport control information. As a result, an apparatus has been created that separates the controlling of a light module from the powering of the light module. Such an apparatus can be used in combination with a manually operated classical dimmer, but offers many more control options than said manually operated classical dimmer. This is a great advantage.

An embodiment of the apparatus is defined by the first control information comprising phase-cut dimming information or first data, and the second control information comprising a parameter of the second signal or second data. When originating from a classical dimmer, the first control information may be phase-cut dimming information. When originating from a digital dimmer, the first control information may be first data. The first control information, as transported via the first signal, can be classical phase-cut dimming information, that carries light intensity information, but can also be modulated information (modulated in an analog or digital way), such as power line communication information, digital load line transmission information and power line protocol information. This first signal can also carry information beyond light intensity, such as group control information or color point information. Each one of both kinds of the first control information may be converted either into a parameter of the second signal, such as an amplitude or a timing or a pulse-width or a pulse-height etc. of the second signal or into second data.

An embodiment of the apparatus is defined by the first and second control information defining different light settings of the light module. The differences may reside in filtering or remapping a parameter value or in a conversion into a different control aspect (such as a control of a color temperature along with dimming an intensity of the light).

An embodiment of the apparatus is defined by the second signal being in accordance with a bus definition, a protocol definition or an interface definition. Bus definitions, protocol definitions and interface definitions are well suited for transporting control information. The second signal may be offered via an interface that enhances a modularity of the system. For example, further products may be developed easily by only replacing the light module.

An embodiment of the apparatus is defined by the first circuit comprising a detector for detecting the first control information or a controller for detecting the first control information. The first control information can be detected via a real detector or via a controller such as a microcontroller that acts as a detector.

An embodiment of the apparatus is defined by the second circuit comprising a controller followed by an isolator. The first control information can be converted into the second control information via a controller such as a micro-controller followed by an isolator such as an opto-coupler for providing galvanic isolation.

An embodiment of the apparatus is defined by the second circuit comprising an isolator followed by a filter. The first control information can be converted into the second control information via an isolator such as an opto-coupler for providing galvanic isolation followed by a filter such as an integrating RC filter. This embodiment allows to change the representation of the information as well as to modify a value of the information. Examples of reasons to modify a content of the information can be removing artifacts (such as mains disturbances and EMC interference signals), smoothing signals (to avoid abrupt changes that are perceived as not pleasant), changing dimming curves (to remap phase cut angles, e.g. 30-150 degrees into a particular (possibly non-linear) light intensity curve between, for example 1% or 10% and 100%), and changing phase angles into a light intensity shift and/or a color point shift (also known as dim-tone, black body line dimming, sunset dimming etc.).

An embodiment of the apparatus is defined by further comprising a third circuit for converting power from the first signal into a third signal, the third signal being a power signal destined for a power input of the light module, and the second signal being destined for a control input of the light module.

The third circuit converts power from the first signal into the third signal. The third signal is a power signal destined for a power input of the light module. The second signal is a control signal destined for a control input of the light module. The control and power inputs may be different terminals of the light module or may be the same terminal of the light module. The second and third signals may be different signals or may form parts of an umbrella signal, but can always be clearly distinguished from each other. Preferably, the second and third signals will be different signals transported via different couplings.

An embodiment of the apparatus is defined by the second and third signals being provided via a same output. Even when being provided via the same output, the second and third signals can be clearly distinguished from each other.

Preferably, the third signal may have a maximum current protection. Thereto, the apparatus may be provided with a current limiter.

An embodiment of the apparatus is defined by the second signal being a DC signal having an amplitude defined by the first control information, and the third signal being a DC signal having a relatively constant amplitude. Future light modules are expected to be controlled via a separate control signal, such as an analog DC control signal (with for example an amplitude from 1 Volt to 10 Volt) or such as a digital control signal (with for example an interface format) and are expected to be powered via a DC power signal.

An embodiment of the apparatus is defined by the third circuit comprising a detecting circuit for detecting a peak voltage via an auxiliary winding of a flyback transformer coupled to a fourth circuit, a determining circuit for determining a difference between the detected peak voltage and a reference value, and an integrating or averaging circuit for integrating or averaging the difference and for providing the integrated or averaged difference to a feedback input of the fourth circuit.

The fourth circuit may be an existing integrated circuit that in response to the first control information produces an output current and that through an introduction of the detecting circuit and the determining circuit and the integrating or averaging circuit is adapted to produce an output voltage. Alternatively, the fourth circuit may, together with the detecting circuit and the determining circuit and the integrating or averaging circuit, be in the form of a novel integrated circuit.

An embodiment of the apparatus is defined by the third circuit comprising a power supply, and the first, second and third circuits being coupled to or forming part of a router. A router may for example be controlled via an IP signal coming from the second circuit. Alternatively, the router may comprise one or more of the first and second and third circuits etc.

An embodiment of the apparatus is defined by the first, second and third circuits forming part of one device having two separate outputs for providing the second and third signals separately from each other or having one output for providing a combination of the second and third signals.

Further, the first and second circuits on the one hand and the third circuit on the other hand should not be looked at too restrictedly. The third circuit may be used fully independently from the first and second circuits. In other words, the apparatus may comprise the third circuit without the first and second circuits being present at all.

According to a second aspect, a light module comprising a light emitting diode circuit is provided for receiving the second signal from the apparatus as defined above.

An embodiment of the light module is defined by the light module receiving the third signal from the apparatus as defined above.

A light emitting diode circuit comprises one or more light emitting diodes of whatever kind and in whatever combination.

One signal for controlling as well as powering a lamp makes it relatively complicated to increase a number of control options. A basic idea is that a control of a light module is to be separated from powering the light module.

A problem to provide an apparatus for controlling a light module has been solved. A further advantage is that many more control options have become possible.

These and other aspects of the invention will be apparent from and elucidated with reference to the embodiments described hereinafter.

DETAILED DESCRIPTION OF EMBODIMENTS

Figure 1:
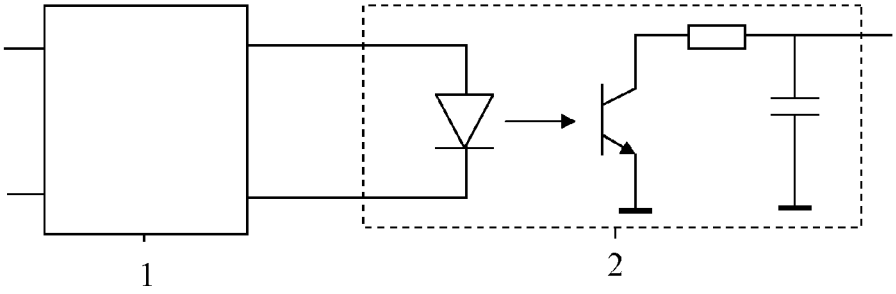
FIG. 1 shows an embodiment of first and second circuits.

In the FIG. 1, an embodiment of first and second circuits 1, 2 is shown. The first circuit 1 comprises for example a phase-cut detector for detecting a phase-cut of a first signal coming from a classical dimmer such as for example a triac dimmer and for providing a pulse width modulation signal. A pulse width of the pulse width modulation signal depends on and may for example be proportional with the detected phase-cut. The second circuit 2 for example comprises an isolator such as for example an opto-coupler followed by a filter such as for example a RC filter having a smoothing function that converts the pulse width modulation signal into a DC voltage signal. An amplitude of the DC voltage signal depends on and may for example be proportional with the pulse width.

Figure 3:
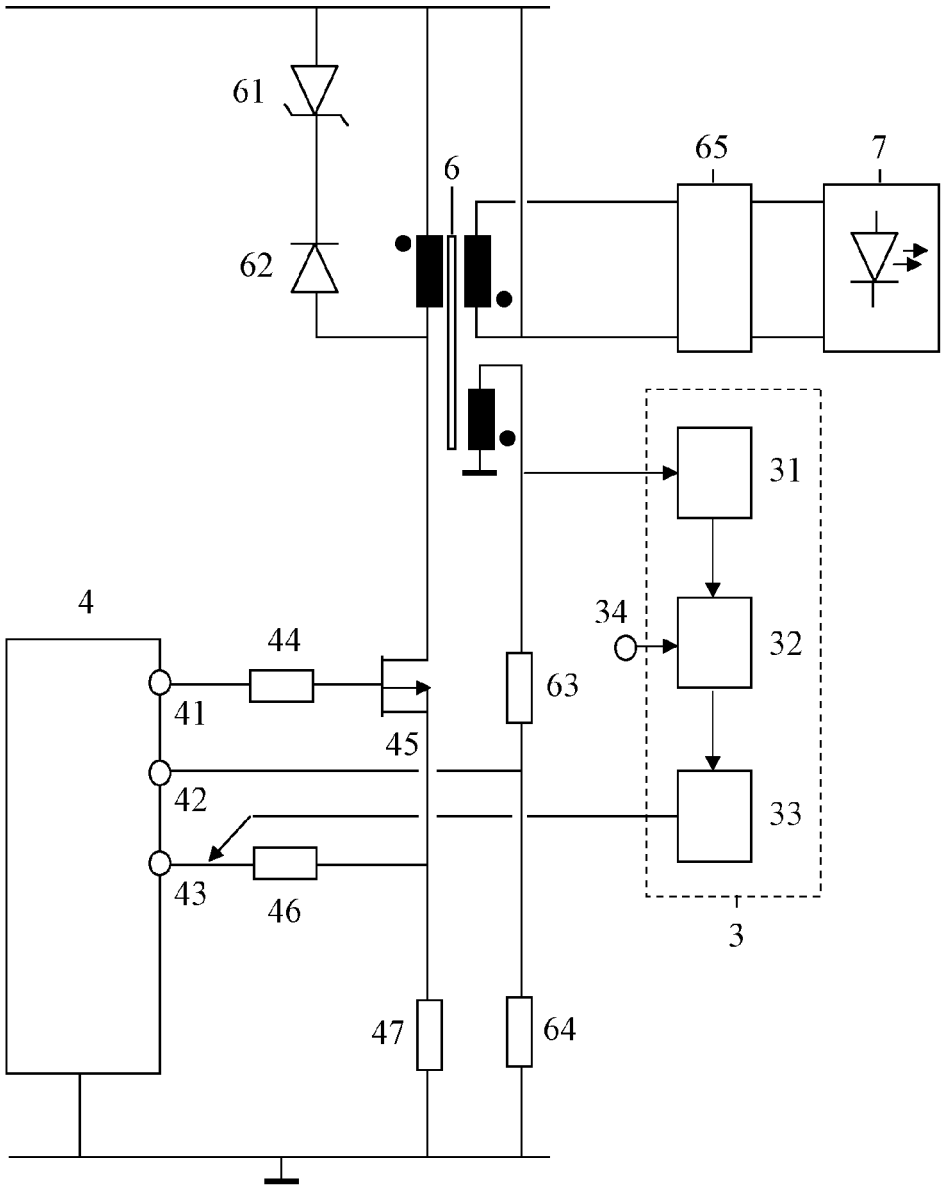
FIG. 3 shows an embodiment of a third circuit.
Figure 7:
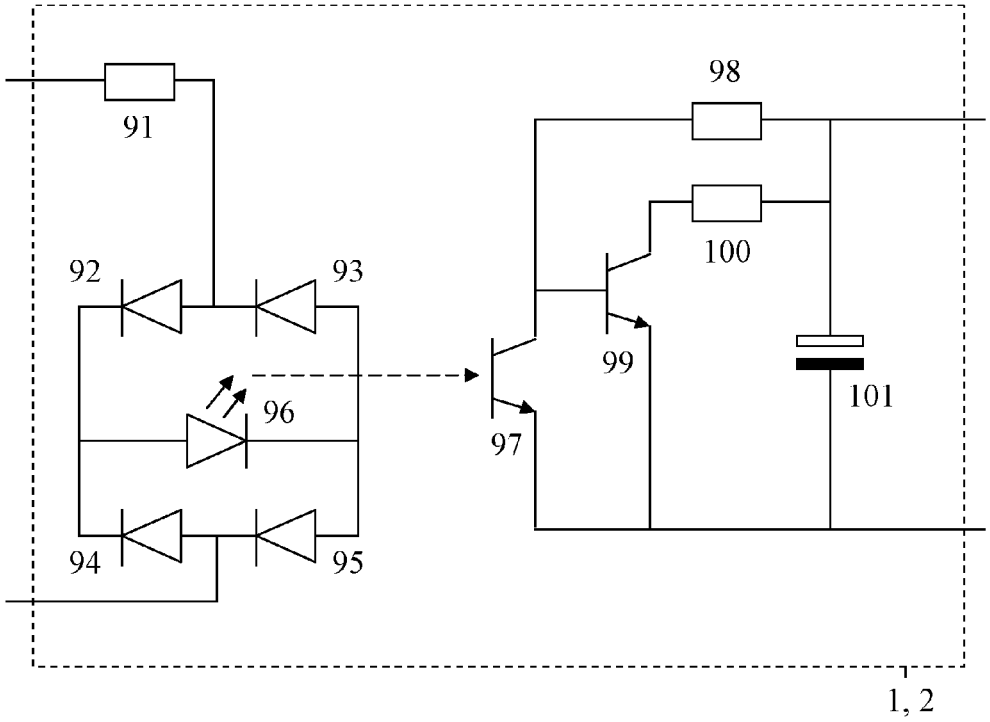
FIG. 7 shows another embodiment of first and second circuits.

Alternatively, the first circuit 1 may for example be realized via a fourth circuit as discussed for the FIG. 3 or may for example be realized as shown in the FIG. 7.

Figure 2:
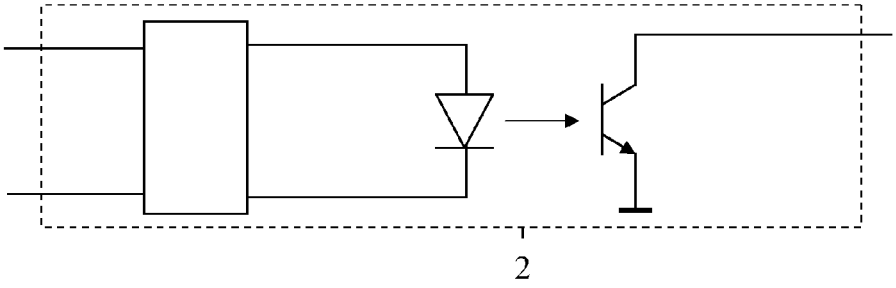
FIG. 2 shows an embodiment of a second circuit.

In the FIG. 2, an embodiment of a second circuit 2 is shown. The second circuit 2 comprises for example a controller followed by an isolator such as for example an opto-coupler. The controller may be connected to certain pins of a fourth circuit as discussed for the FIG. 3. Alternatively, the second circuit 2 may i.e. be realized as shown in the FIG. 7.

In the FIG. 3, an embodiment of a third circuit 3 is shown. The third circuit 3 comprises a detecting circuit 31 for detecting a peak voltage via an auxiliary winding of a flyback transformer 6 coupled to a fourth circuit 4. The third circuit 3 further comprises a determining circuit 32 for determining a difference between the detected peak voltage and a reference value offered via a terminal 34. The third circuit 3 further comprises an integrating or averaging circuit 33 for integrating or averaging the difference and for providing the integrated or averaged difference to a feedback input 43 of the fourth circuit 4.

The fourth circuit 4 such as for example an integrated circuit that is available on the market is used for detecting first control information transported via a first signal that for example originates from a classical dimmer such as for example a triac dimmer. In other words, the fourth circuit 4 plays the role of the first circuit 1, whereby the second circuit 2 as shown in the FIG. 2 may be connected to for example I2C pins of the fourth circuit 4, which pins are not shown here.

A secondary side main winding of the flyback transformer 6 is coupled via a filtering circuit 65 to a lamp 7 comprising a light emitting diode circuit. A primary side main winding of the flyback transformer 6 is coupled in parallel to a serial connection of a zener diode 61 and a diode 62 and is coupled serially to a serial connection of main electrodes of a transistor 45 and a resistor 47. A control electrode of the transistor 45 is coupled via a resistor 44 to an output terminal of the fourth circuit 4. A common point between the transistor 45 and the resistor 47 is coupled via a resistor 46 to the feedback input 43 of the fourth circuit 4. The auxiliary winding of the flyback transformer 6 here for example at the secondary side is coupled serially to a serial connection of two resistors 63, 64. A common point between the auxiliary winding and the serial connection is coupled to an input of the detecting circuit 31 (possibly via a resistor), and a common point between the two resistors 63, 64 is coupled to another feedback input 42 of the fourth circuit 4. An output of the third circuit 3 is coupled to the feedback input 43 (possibly via a resistor).

In a prior art situation, a combination of the fourth circuit 4 and the flyback transformer 6 provides a current signal to the lamp 7, the current signal having an amplitude that depends on the first control information, such as a phase-cut. In the improved situation, by having added the third circuit 3, a combination of the fourth circuit 4 and the flyback transformer 6 provides a voltage signal to the lamp 7, the voltage signal having a fixed amplitude. A control of the lamp 7 is then to be realized by for example adding the second circuit 2 as shown in the FIG. 2 to the FIG. 3 as also discussed before, whereby the lamp 7 is to be replaced by a light module 5 as for example shown in the FIG. 6.

In the FIG. 3, more components may be present, for example in an electromagnetic interference stage, in a bias stage, in a boost stage, in a steady state supply stage and in an active clamp stage, with the flyback transformer 6 forming the heart of a flyback stage etc. In the FIG. 3, the third circuit 3 converts, in cooperation with the fourth circuit 4 and the flyback transformer 6, power from the first signal into the third signal, the third signal being a power signal destined for a power input of the light module 5 as further discussed at the hand of the FIG. 6. Similarly, the second signal produced by the second circuit 2 may be destined for a control input of the light module 5 as further discussed at the hand of the FIG. 6.

Figure 4:
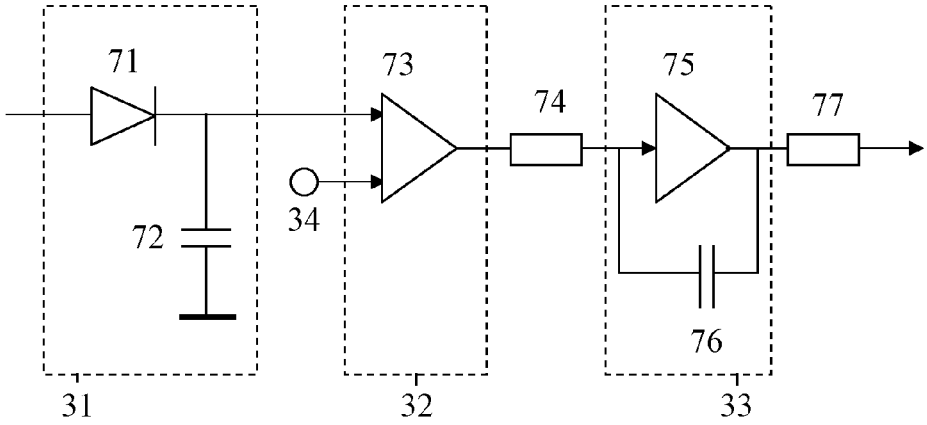
FIG. 4 shows an implementation of the embodiment of the third circuit.

In the FIG. 4, an implementation of the embodiment of the third circuit 3 is shown. The detecting circuit 31 is realized via a diode 71 with an anode forming an input of the third circuit 3 and with a cathode coupled via a capacitor 72 to ground. The determining circuit 32 is realized via an amplifier 73 with a first input coupled to said cathode and with a second input coupled to said terminal 34 and with an output coupled to a resistor 74. The integrating or averaging circuit 33 is realized via an amplifier 75 with an input coupled to said resistor 74 and with an output coupled to a resistor 77 that forms an output of the third circuit 3. A capacitor 76 is used for feeding back the output of the amplifier 75 to the input of this amplifier 75.

Figure 5:
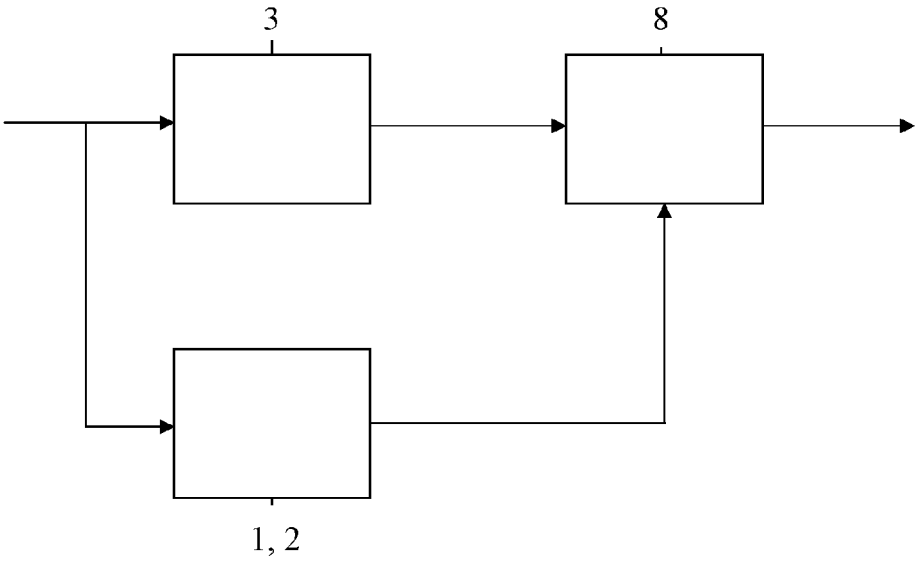
FIG. 5 shows an embodiment of an apparatus with a router.

In the FIG. 5, an embodiment of an apparatus with a router 8 is shown. The apparatus comprises the first and second circuits 1, 2 as discussed before and comprises the third circuit 3 for example in the form of a power supply, whereby an output of the third circuit 3 is coupled to a power input of the router 8 and whereby an output of the second circuit 2 is coupled to a control input of the router 8. The router 8 may form part of the apparatus or not. One of more of the first, second and third circuits 1, 2 and 3 may form part of the router 8 or not. An output of the router 8 may for example be connected to a cable such as a cat five cable etc.

Figure 6:
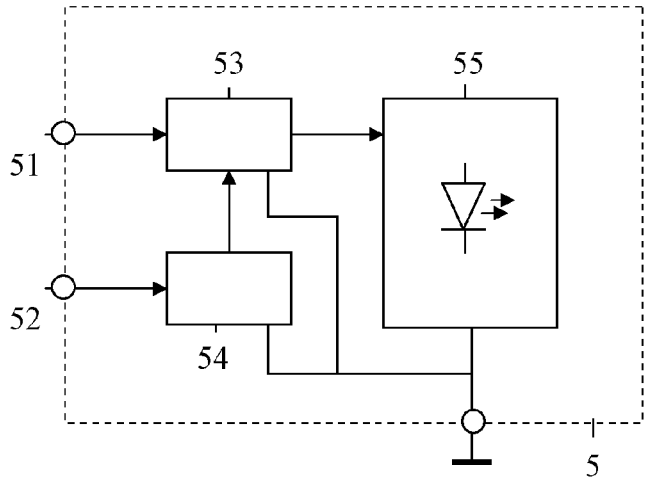
FIG. 6 shows an embodiment of a light module.

In the FIG. 6, an embodiment of a light module 5 is shown. The light module 5 comprises a power input 51 for receiving a power signal (third signal) from the third circuit 3 when comprising a power supply or from a secondary side main winding of the flyback transformer 6 when used in combination with the third and fourth circuits 3, 4 in the FIG. 3. The light module 5 comprises a control input 52 for receiving a control signal (second signal) from the second circuit 2. The light module 5 further comprises a power unit 53 coupled to the power input 51 and to an input of a light emitting diode circuit 55 and a control unit 54 coupled to the control input 52 and to a control input of the power unit 53 for controlling the power unit 53 in response to the control signal. The units 53, 54 and the circuit 55 are further coupled to ground. Instead of ground, a two-wire solution may be chosen. Alternatively, both inputs 51 and 52 may be realized via the same input, whereby the units 53, 54 are configured to distinguish the second and third signals. Alternatively, another unit may be present for said distinguishing. The power unit 53 may for example comprise a voltage-to-current-converter etc. The control unit 54 may for example comprise a processor or a micro-controller etc. and may for example comprise, in addition to its input and output, a control input to be coupled to for example a sensor such as a daylight sensor for making a control further dependent on an amount of daylight etc.

In the FIG. 7, another embodiment of first and second circuits 1, 2 is shown. In the first circuit 1, a resistor 91 is coupled to a first input terminal of the first circuit and coupled to a first input of a rectifier bridge 92-95 consisting of four diodes 92, 93, 94 and 95. A second input terminal of the first circuit 1 is coupled to a second input of the rectifier bridge 92-95. Outputs of the rectifier bridge 92-95 are coupled to a photodiode 96 of an opto-coupler 96, 97. In the second circuit 2, a first main electrode of a transistor 97 of the opto-coupler 96, 97 is coupled via a resistor 98 to a first output terminal of the second circuit. A second main electrode of the transistor 97 is coupled to a second output terminal of the second circuit 2. In the second circuit 2, a first control electrode of a transistor 99 is coupled to the first main electrode of the transistor 97. A first main electrode of the transistor 99 is coupled via a resistor 100 to the first output terminal of the second circuit 2. A second main electrode of the transistor 99 is coupled to the second output terminal of the second circuit 2. Finally, a capacitor 101 is coupled to the first and second output terminals of the second circuit 2.

The resistor 91 may for example have a value of 68 k Ohm, the resistor 98 may for example have a value of 50 k Ohm, the resistor 100 may for example have a value of 1 k Ohm, and the capacitor 101 that creates a smoothed DC output voltage may for example have a value of 10μ Farad, without having excluded other values. The transistor 99 has an inverting function. The input terminals are to be coupled to for example the outputs of a classical dimmer. When not dimming or when dimming to a relatively small extent, current will flow through the photodiode 96 during a relatively large percentage of time, the transistor 97 will conduct during a relatively large percentage of time, the transistor 99 will not conduct or only during a relatively small percentage of time and will then not pull down the DC output voltage or pull it down to a relatively small extent, and between the output terminals a DC output voltage of for example 1 . . . 10 Volt will be present. When dimming to a relatively large extent, current will flow through the photodiode 96 during a relatively small percentage of time, the transistor 97 will conduct during a relatively small percentage of time, the transistor 99 will conduct during a relatively large percentage of time and will then pull down the DC output voltage to a relatively large extent, and between the output terminals a reduced DC output voltage will be present.

So, an apparatus for controlling a light module 5 comprising a light emitting diode circuit 55 comprises in a minimum situation a first circuit 1 for detecting first control information, the first control information being transported via a first signal such as a combination of a power signal and a control signal, and a second circuit 2 for converting the first control information into second control information. The first and second control information define light settings of the light module 5. A representation of the second control information may be different from a representation of the first control information. The second control information may be transported via a second signal such as a control signal.

The first control information may be phase-cut information (produced by a classical dimmer) or first data (produced by a digital dimmer), the second control information may be a parameter of the second signal or second data. The second signal may be in accordance with a bus definition, a protocol definition or an interface definition. Each one of said definitions may be already standardized or not or may be standardized in the future.

The third circuit 3 is designed to convert power from the first signal into a third signal and may be designed to produce the third signal itself or to cooperate with a fourth circuit 4 and a flyback transformer 1 for producing the third signal. This third signal may be a power signal for powering the light module 5. The second and third signals may be provided via a same output of the apparatus or not. Preferably, the third signal may be a DC signal, further preferably protected against a current getting a too high value. Preferably, the second signal may be a DC signal having an amplitude defined by the first control information, and the third signal may be a DC signal having a relatively constant amplitude.

Another illustrative example uses a presence sensor and a daylight sensor. An office illumination system can then automatically respond to changing daylight conditions and to changing occupancy conditions. Typically the first control information (occupancy information) from such a presence sensor is transported in the form of phase-cut dimming information that is sent to all light modules. As disclosed, inside the office illumination system, such first control information is converted into second control information that is more suitable for combination with other control commands. In fact, in addition, daylight information is transported via a separate signal, for instance as a 1 . . . 10 Volt signal, via a separate cable. Inside the office illumination system, the separate daylight information is combined with the second control information (converted occupancy information), to derive a most suitable lighting setting.

First and second elements may be coupled directly without a third element being in between or may be coupled indirectly via a third element.

Summarizing, apparatuses for controlling light modules 5 comprise first circuits 1 for detecting first control information transported via first signals and second circuits 2 for converting first control information into second control information. The second control information is transported via second signals. The first and second control information define light settings of the light modules 5 and have different representations. The first control information may be phase-cut information or first data. The second control information may be a parameter of the second signal or second data. The apparatus may further comprise a third circuit 3 for converting power from the first signals into third signals destined for power inputs 51 of the light modules 5. The second signals may be destined for control inputs 52 of the light modules 5. This way, a control of a light module 5 has been separated from powering the light module 5. Many more control options have become possible.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. An apparatus for controlling a light module, the apparatus comprising a first circuit for detecting first control information, the first control information being transported via a first signal, the first signal being a combination of a power signal and a control signal a second circuit for converting the first control information into second control information, the first and second control information defining light settings of the light module, a representation of the second control information being different from a representation of the first control information, the second control information being transported via a second signal and the second signal being a control signal destined for a control input of the light module, and a third circuit for converting power from the first signal into a third signal, the third signal being a power signal destined for a power input of the light module.

2. The apparatus as defined in claim 1, the first control information comprising phase-cut dimming information or first data, and the second control information comprising a parameter of the second signal or second data.

3. The apparatus as defined in claim 1, the first and second control information defining different light settings of the light module.

4. The apparatus as defined in claim 1, the second signal being compatible to a bus definition, a protocol definition or an interface definition.

5. The apparatus as defined in claim 1, the first circuit comprising a detector for detecting the first control information or a controller for detecting the first control information.

6. The apparatus as defined in claim 1, the second circuit comprising a controller in front of an isolator.

7. The apparatus as defined in claim 1, the second circuit comprising an isolator in front of a filter.

8. The apparatus as defined in claim 1, the second and third signals being provided via a same output.

9. The apparatus as defined in claim 1, the second signal being a DC signal having an amplitude defined by the first control information, and the third signal being a DC signal having a relatively constant amplitude.

10. The apparatus as defined in claim 1, the third circuit comprising a detecting circuit for detecting a peak voltage via an auxiliary winding of a flyback transformer coupled to a fourth circuit, a determining circuit for determining a difference between the detected peak voltage and a reference value, and an integrating or averaging circuit for integrating or averaging the difference and for providing the integrated or averaged difference to a feedback input of the fourth circuit.

11. The apparatus as defined in claim 1, the third circuit comprising a power supply, and the first, second and third circuits being coupled to or forming part of a router.

12. The apparatus as defined in claim 1, the first, second and third circuits forming part of one device having two separate outputs for providing the second and third signals separately from each other.

13. The apparatus as defined in claim 1, the first, second and third circuits forming part of one device having one output for providing a combination of the second and third signals.

14. A light module comprising a light emitting diode circuit for receiving the second signal from the apparatus as defined in claim 1.

15. The light module as defined in claim 14 for receiving the third signal from the apparatus.

* * * * *